US009194275B2

(12) United States Patent
Ogimura

(10) Patent No.: US 9,194,275 B2
(45) Date of Patent: Nov. 24, 2015

(54) VEHICLE

(71) Applicant: TOYOTA JIDOSHA KABUSHIKI KAISHA, Toyota-shi, Aichi-ken (JP)

(72) Inventor: Shoji Ogimura, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/319,577

(22) Filed: Jun. 30, 2014

(65) Prior Publication Data

US 2015/0008069 A1 Jan. 8, 2015

(30) Foreign Application Priority Data

Jul. 4, 2013 (JP) ..... 2013-140796

(51) Int. Cl.
*F01N 13/08* (2010.01)

(52) U.S. Cl.
CPC ..... *F01N 13/08* (2013.01)

(58) Field of Classification Search
CPC ..... F01N 13/08
USPC ..... 181/228, 227
See application file for complete search history.

(56) References Cited

U.S. PATENT DOCUMENTS 6,405,826 B1 * 6/2002 Bass ..... 181/228
7,931,119 B2 * 4/2011 Fujita ..... 181/228
2004/0041320 A1 * 3/2004 Hodumi ..... 267/220
2005/0247516 A1 * 11/2005 Uegane ..... 181/228
2012/0049424 A1 * 3/2012 Bradshaw et al. ..... 267/140.14
2012/0292837 A1 * 11/2012 Hettler et al. ..... 267/140.11
2014/0182986 A1 * 7/2014 Nakajima ..... 188/313

FOREIGN PATENT DOCUMENTS

EP 1091139 A1 * 4/2001 ..... F16F 7/02
JP 62-179320 U 11/1987
JP 3-7550 U 1/1991
JP 4-24615 U 2/1992
JP 05-248236 A 9/1993
JP 06-264710 A 9/1994
JP 11-107746 A 4/1999
JP 2007-137298 A 6/2007
JP 2013-119879 A 6/2013

OTHER PUBLICATIONS

Partial Translation of Communication dated Jul. 14, 2015, issued by the Japan Patent Office in corresponding Japanese Application No. 2013-140796.

* cited by examiner

*Primary Examiner* — Forrest M Phillips
(74) *Attorney, Agent, or Firm* — Sughrue Mion, PLLC

(57) ABSTRACT

A vehicle is equipped with an internal combustion engine, and an exhaust pipe of the internal combustion engine is supported on a vehicle body by a plurality of support members. A support member positioned on the mostdownstream side of the exhaust pipe, among the plurality of the support members, is a buffer member functioning as a resonance suppression mechanism that suppresses the resonance of the exhaust pipe.

7 Claims, 1 Drawing Sheet

VEHICLE

INCORPORATION BY REFERENCE

The disclosure of Japanese Patent Application No. 2013-140796 filed on Jul. 4, 2013 including the specification, drawings and abstract is incorporated herein by reference in its entirety.

BACKGROUND OF THE INVENTION

1. Field of the Invention

The invention relates to a vehicle equipped with an internal combustion engine, the vehicle having a resonance suppression mechanism that suppresses the resonance of the exhaust pipe of the internal combustion engine.

2. Description of Related Art

Japanese Patent Application Publication No. 2007-137298 (JP 2007-137298 A) discloses a hanger rubber as a support member that supports an exhaust pipe. Two holes are formed in the hanger rubber. The exhaust pipe is suspended on a vehicle body by inserting an exhaust-pipe-side stay protruding from the exhaust pipe into one of the two holes, and inserting a vehicle-body-side stay protruding from the vehicle body is inserted into the other hole. Further, a mass body formed from a metal or the like is embedded in the hanger rubber around the hole connected to the exhaust-pipe-side stay. JP 2007-137298 A indicates that the resonance of the exhaust pipe is suppressed by setting the volume of the mass body to an appropriate value. Thus, the mass body functions as a resonance suppression mechanism that suppresses the resonance of the exhaust pipe.

However, in order to suppress effectively the resonance of the exhaust pipe, it is desirable that the support member having the resonance suppression mechanism be provided at the adequate position of the exhaust pipe. However, in JP 2007-137298 A, the arrangement position of the hanger rubber in which the mass body has been embedded is not described, and there is a room for improvement in this regard.

SUMMARY OF THE INVENTION

The invention provides a vehicle in which the resonance of an exhaust pipe can be effectively suppressed.

The vehicle is equipped with an internal combustion engine, and the exhaust pipe of the internal combustion engine is supported on a vehicle body by a plurality of support members. A resonance suppression mechanism that suppresses a resonance of the exhaust pipe is provided at at least the support member positioned on a mostdownstream side of the exhaust pipe, among the plurality of the support members.

With such a configuration, the resonance suppression mechanism is provided at the support member that is the farthest from the internal combustion engine which is the source of vibrations. As a result, the function of suppressing the wide range resonance of the exhaust pipe can be imparted to the support member positioned on mostdownstream side. Therefore, the resonance of the exhaust pipe can be effectively suppressed.

Examples of the resonance suppression mechanism may include a mechanism that attenuates vibrations acting upon the resonance suppression mechanism by converting the vibrations into heat using viscosity of a fluid, and a mechanism that attenuates vibrations acting upon the resonance suppression mechanism by converting the vibrations into heat using friction.

With such configurations, the vibrations acting upon the resonance suppression mechanism are converted into heat and absorbed by the resonance suppression mechanism. Therefore, the vibrations inputted to the resonance suppression mechanism are unlikely to be reflected. By suppressing the reflection of vibrations in such a manner, it is possible to suppress the occurrence of a resonance caused by superposition of the incidence wave propagating from the internal combustion engine in the exhaust pipe toward the downstream side thereof and the reflection wave reflected by the resonance suppression mechanism, and the resonance of the exhaust pipe can be effectively suppressed.

For example, a mechanism in which the value of an internal resistance can be adjusted may be used as the resonance suppression mechanism. With the abovementioned configuration, the amount of friction or value of viscosity, which is the internal resistance in the resonance suppression mechanism, can be adjusted according to the characteristics of vibrations generated in the exhaust pipe or characteristics of the exhaust pipe.

When the internal resistance value of the resonance suppression mechanism is denoted by $\eta$, the tension of the entire exhaust pipe is denoted by F, the average propagation speed of vibrations acting upon the resonance suppression mechanism is denoted by c, and the average density of the entire exhaust pipe is denoted by $\sigma$, where the internal resistance value $\eta$ is adjusted such that the relationship represented by Eq. (1) below is fulfilled, the vibrations inputted to the resonance suppression mechanism are prevented from being reflected. Therefore, the occurrence of a resonance caused by superposition of the incidence wave propagating from the internal combustion engine in the exhaust pipe toward the downstream side thereof and the reflection wave reflected by the resonance suppression mechanism, can be suppressed.

$$\eta = F/c\sqrt{(F\times\sigma)} \quad (1)$$

Further, since the frequency $\omega$ is equal to a product ($k\times c$) of the elastic constant k of the exhaust pipe and the average propagation speed c, the internal resistance value $\eta$ can be also calculated by substituting a value ($\omega/k$), which is obtained by dividing the frequency $\omega$ by the elastic constant k, instead of the average propagation speed c in Eq. (1).

Therefore, when the value of internal resistance is adjusted, the value of internal resistance may be adjusted on the basis of the frequency of vibrations acting upon the resonance suppression mechanism and the tension of the entire exhaust pipe, or the value of internal resistance may be adjusted on the basis of the tension of the entire exhaust pipe and either of the average density of the entire exhaust pipe and the average propagation speed of the vibrations acting upon the resonance suppression mechanism.

A sensor that measures the characteristic of vibrations generated in the exhaust pipe may be further provided and the value of the internal resistance may be adjusted on the basis of a measured value measured by the sensor during the engine operation. With such a configuration, even when the characteristic of vibrations generated in the exhaust pipe changes during the engine operation, the value of internal resistance in the resonance suppression mechanism can be adjusted according to such changes and the resonance in the exhaust pipe can be effectively suppressed.

The resonance suppression mechanism may include inside thereof an elastic member and a liquid chamber filled with a working oil. The liquid chamber may be formed to be comparted into two spaces as a pressure receiving chamber and a balancing chamber, and the pressure receiving chamber and the balancing chamber may communicate with each other by a communication passage with an adjustable cross-sectional area. With such a configuration, where vibrations act from the exhaust pipe upon the resonance suppression mechanism, the elastic member is deformed, the volume of the pressure receiving chamber is changed, and the working oil flows as a fluid through the communication passage. As a result, the vibrations are attenuated by the flow channel resistance generated when the working oil flows through the communication passage. In the resonance suppression mechanism, the hydrodynamic resistance of the working oil generated when the working oil flows through the communication passage, that is, the value of the internal resistance of the resonance suppression mechanism, can be adjusted.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

DETAILED DESCRIPTION OF EMBODIMENTS (First Embodiment) The first embodiment of the vehicle equipped with an internal combustion engine will be explained hereinbelow with reference to FIG. 1. As shown in FIG. 1, a ball joint unit 13, an exhaust purification catalyst 14, and a muffler 15 (two mufflers in the present embodiment) are provided, in the order from the upstream side of an exhaust pipe 12, at the exhaust pipe of an internal combustion engine 11 provided in a vehicle 10. In the ball joint unit 13, the upstream and downstream exhaust pipes 12 are connected by a spherical movable unit such that the exhaust pipes can rotate relative to each other in a fixed range. As a result, vibrations transferred from the internal combustion engine 11 to the ball joint unit 13 are absorbed. The exhaust purification catalyst 14 oxidizes hydrocarbons (HC) and carbon monoxide (CO) contained in the exhaust gas and reduces nitrogen oxides (NOx), thereby purifying the exhaust gas.

Figure 1:
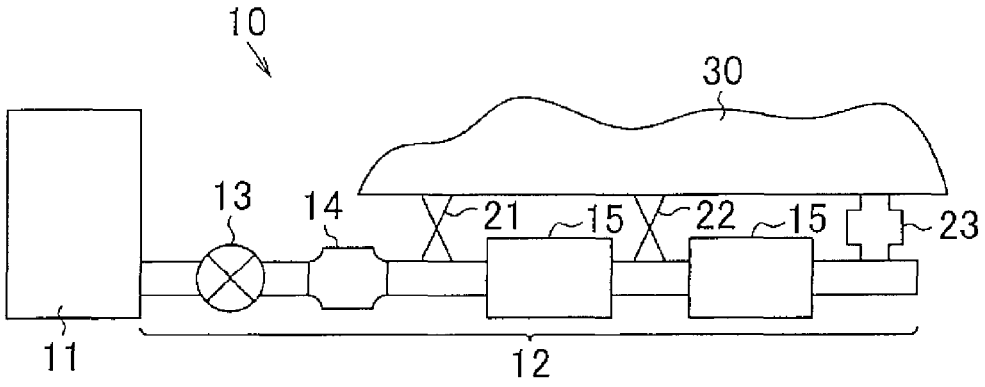
FIG. 1 is a schematic diagram illustrating the support structure of the exhaust pipe in the vehicle of the first embodiment.

The exhaust pipe 12 is supported at a vehicle body 30 by a plurality of support members. Two hanger rubbers 21, 22 and a buffer member 23 are provided in the order from the upstream side of the exhaust pipe 12 as the support members supporting the exhaust pipe 12. Two holes are provided in each of the hanger rubbers 21, 22. An exhaust-pipe-side stay protruding from the exhaust pipe 12 is inserted into one hole, and a vehicle-side stay protruding from the vehicle body 30 is inserted into the other hole. As a result of the stays being inserted into the respective holes, the exhaust pipe 12 is suspended on the vehicle body 30 by the hanger rubbers 21, 22.

For example, the buffer member 23 has the following configuration. Specifically, the buffer member 23 includes inside thereof an elastic member and a liquid chamber filled with working oil. The liquid chamber is formed to be comparted into two spaces as a pressure receiving chamber and a balancing chamber, and those chambers communicate with each other by a communication passage with an adjustable cross-sectional area. Where vibrations act from the exhaust pipe 12 upon the buffer member 23, the elastic member is deformed, the volume of the pressure receiving chamber is changed, and the working oil flows as a fluid through the communication passage. As a result, the vibrations are attenuated by the flow channel resistance generated when the working oil flows through the communication passage. In the buffer member 23, the hydrodynamic resistance of the working oil generated when the working oil flows through the communication passage, that is, the value of the internal resistance of the buffer member 23, can be adjusted. Essentially, the buffer member 23 demonstrates a function of using the viscosity of the working oil sealed inside thereof to convert the vibrations into heat and attenuate the vibrations, as in the engine mount of a liquid sealed system. By sealing the measured amount of the working oil in the liquid chamber, it is possible to obtain the configuration of the buffer member 23 in which the vibrations are attenuated using the working oil sealed inside the liquid chamber.

Where the value of the internal resistance is adjusted in the below-described manner, the buffer member 23 functions as a resonance suppression mechanism suppressing the resonance of the exhaust pipe 12. Thus, when the internal resistance value of the buffer member 23 is denoted by $\eta$, the tension of the entire exhaust pipe 12 is denoted by F, the average propagation speed of vibrations acting upon the buffer member 23 is denoted by c, and the average density of the entire exhaust pipe 12 is denoted by $\sigma$, where the internal resistance value $\eta$ of the buffer member 23 is adjusted such that the relationship represented by Eq. (1) below is fulfilled, the vibrations inputted to the buffer member 23 are prevented from being reflected.

$$\eta = F/c\sqrt{(F \times \sigma)} \quad (1)$$

Since the frequency $\omega$ is equal to a product ($k \times c$) of the elastic constant k of the exhaust pipe 12 and the average propagation speed c, the internal resistance value $\eta$ can be also calculated by substituting a value ($\omega/k$), which is obtained by dividing the frequency $\omega$ by the elastic constant k, instead of the average propagation speed c in Eq. (1).

Accordingly, in the vehicle 10 of the present embodiment, the occurrence of a resonance in the exhaust pipe 12 is confirmed by an evaluation test or computer simulation performed in advance. After the occurrence of the resonance in the exhaust pipe 12 has been confirmed, the internal resistance value $\eta$ which fulfills the relationship represented by Eq. (1) above is calculated using a value ($\omega 1/k$) obtained by dividing the resonance frequency $\omega 1$, which is the frequency of this resonance, by the elastic constant k of the exhaust pipe 12. The value of the internal resistance of the buffer member 23 is then adjusted to become equal to the calculated internal resistance value $\eta$. More specifically, the value of the internal resistance is adjusted by adjusting the cross-sectional area of the communication passage connecting the pressure receiving chamber and balancing chamber, or by measuring the amount of the working oil sealed in the liquid chamber.

The operation of the buffer member 23 is explained below. Where vibrations are inputted to the exhaust pipe 12 from the internal combustion engine 11 which is the source of vibrations, the vibrations propagate in the exhaust pipe 12, and the vibrations also act upon the buffer member 23 positioned at the mostdownstream side of the exhaust pipe 12, among the support members. The vibrations incident upon the buffer member 23 are converted into heat by the hydrodynamic resistance of the working oil flowing through the communication passage in the buffer member 23. Since the vibrations incident upon the buffer member 23 are thus converted into heat and absorbed, the vibrations generated in the exhaust pipe 12 are attenuated. When the relationship represented by Eq. (1) above is fulfilled, the vibrations inputted to the buffer member 23 are not reflected. Therefore, when the frequency of the vibrations incident upon the buffer member 23 is close to the resonance frequency ω1, practically no reflection wave is generated from the buffer member 23.

The following effects can be demonstrated with the above-described vehicle 10. (1) The resonance suppression mechanism that attenuates vibrations by using the viscosity of the working oil inside thereof is provided at the buffer member 23. Thus, the resonance suppression mechanism is provided at the buffer member 23, which is the support member farthest from the internal combustion engine 11 which is the source of vibrations. For this reason, the buffer member 23 can be imparted with the function of suppressing the wide range resonance of the exhaust pipe 12. Therefore, the resonance of the exhaust pipe 12 can be effectively suppressed.

(2) Since the vibrations acting upon the buffer member 23 are converted into heat and absorbed in the buffer member 23, the vibrations inputted to the buffer member 23 are unlikely to be reflected. By suppressing the reflection of vibrations in such a manner it is possible to suppress the occurrence of a resonance caused by superposition of the incident wave propagating from the internal combustion engine 11 through the exhaust pipe 12 to the downstream side and the reflected wave reflected by the buffer member 23, and the resonance in the exhaust pipe 12 can be effectively suppressed.

(3) By adjusting the internal resistance η of the buffer member 23 on the basis of Eq. (1) above, it is possible to adjust the value of the internal resistance of the buffer member 23 according to the characteristic of vibrations generated in the exhaust pipe 12 or the characteristic of the exhaust pipe 12. Thus, by adjusting the value of the internal resistance of the buffer member 23 in accordance with the measured resonance frequency ω1, it is possible to suppress the resonance of the exhaust pipe 12. Therefore, an effective measure against the resonance can be taken easier than with the method of the related art in which an evaluation test or computer simulation is repeated each time the characteristic of the resonance suppression mechanism is changed.

(4) When vibrations with a frequency close to the resonance frequency ω1 are incident upon the buffer member 23, the reflection thereof is significantly suppressed and the occurrence of a resonance caused by the superposition of the incident wave and reflected wave can be significantly suppressed.

(Second Embodiment) In the above-described first embodiment, the internal resistance of the buffer member 23 functioning as a resonance suppression mechanism is adjusted in advance on the basis of evaluation test or simulation results, but in the second embodiment, values used for calculating the internal resistance are measured during the engine operation, thereby making it possible to adjust the internal resistance of the resonance suppression mechanism during the engine operation. Explained below is mainly the difference between the first and second embodiments.

Figure 2:
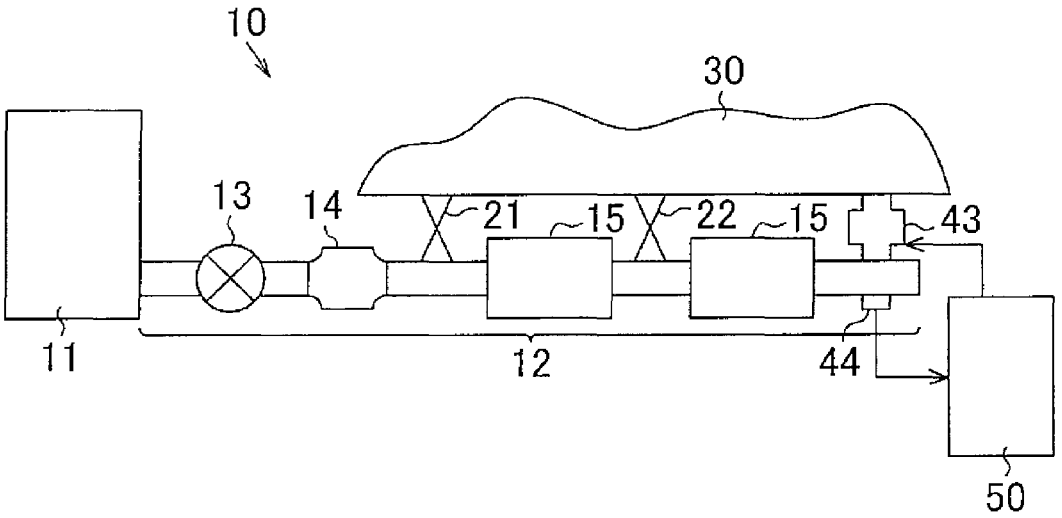
FIG. 2 is a schematic diagram illustrating the support structure of the exhaust pipe in the vehicle of the second embodiment.

As shown in FIG. 2, in the present embodiment, the two hanger rubbers 21, 22 and a buffer member 43 are also provided in the order from the upstream side of the exhaust pipe 12 as a plurality of support members supporting the exhaust pipe 12. The configuration of the buffer member 43 is the same as that of the buffer member 23 in the above-described first embodiment.

However, in the exhaust pipe 12 of the present embodiment, an acceleration sensor 44 is provided as a sensor that measures the characteristic of vibrations generated in the exhaust pipe 12. The measured value obtained with the acceleration sensor 44 is inputted to a control device 50. The adjustment of the cross-sectional area of the communication passage in the buffer member 43 is then performed in response to a command from the control device 50 on the basis of the inputted value measured by the acceleration sensor 44. As a result, the value of the hydrodynamic resistance of the working oil generated when the working oil flows through the communication passage, that is, the value of the internal resistance of the buffer member 43, can be adjusted during the engine operation. The measurements with the acceleration sensor 44 are performed with a predetermined period during the engine operation.

Where the value of the internal resistance is adjusted in the below-described manner, the buffer member 43 functions as a resonance suppression mechanism suppressing the resonance of the exhaust pipe 12. Thus, when the internal resistance value of the buffer member 43 is denoted by η, the tension of the entire exhaust pipe 12 is denoted by F, and the average propagation speed of vibrations acting upon the buffer member 43 is denoted by c, where the internal resistance value η is adjusted such that the relationship represented by Eq. (1) above is fulfilled, the vibrations inputted to the buffer member 43 are prevented from being reflected. Therefore, the occurrence of a resonance caused by superposition of the incident wave propagating from the internal combustion engine 11 through the exhaust pipe 12 to the downstream side and the reflected wave reflected by the resonance suppression mechanism is suppressed. Accordingly, in the present embodiment, the internal resistance of the buffer member 43 is adjusted on the basis of the frequency ω of vibrations in the exhaust pipe 12, which has been measured by the acceleration sensor 44, such that the relationship represented by Eq. (1) above is fulfilled. The average propagation speed is denoted by c, and a value (ω/k) obtained by dividing the frequency ω of vibrations in the exhaust pipe 12, which has been measured by the acceleration sensor 44, by the elastic constant k of the exhaust pipe 12 is used.

The operation of the buffer member 43 is explained below. Where vibrations are inputted to the exhaust pipe 12 from the internal combustion engine 11 which is the source of vibrations, the vibrations propagate in the exhaust pipe 12, and the vibrations also act upon the buffer member 43 positioned at the mostdownstream side of the exhaust pipe 12, among the support members. The vibrations incident upon the buffer member 43 are converted into heat by the hydrodynamic resistance of the working oil flowing through the communication passage in the buffer member 43. Since the vibrations incident upon the buffer member 43 are thus converted into heat and absorbed, the vibrations generated in the exhaust pipe 12 are attenuated. When the relationship represented by Eq. (1) above is fulfilled, the vibrations inputted to the buffer member 43 are not reflected. In the present embodiment, the internal resistance of the buffer member 43 is adjusted on the basis of the frequency ω of vibrations in the exhaust pipe 12, which has been measured by the acceleration sensor 44, such that the relationship represented by Eq. (1) above is fulfilled. Therefore, practically no reflection wave is generated from the buffer member 43.

With vehicle 10 provided with the above-described support members, the following effects can be demonstrated in addition to the effects (1) to (3) that can be obtained in the first embodiment. (5) Even when the characteristic of vibrations generated in the exhaust pipe 12 changes during the engine operation, the value of the internal resistance in the buffer member 43 can be adjusted according to this change and the resonance in the exhaust pipe 12 can be effectively suppressed.

The above-described embodiments can be also implemented in the following variations. In the first embodiment, a support member having another resonance suppression mechanism that attenuates the vibrations by using the viscosity of a fluid may be used instead of the buffer member 23. For example, a hanger rubber having a liquid sealed inside thereof, or an oil damper provided with a piston movable inside a cylinder filled with a liquid may be used. Those resonance suppression mechanisms are also preferably configured such that the value of the hydrodynamic resistance generated inside thereof, that is, the value of the internal resistance of the resonance suppression mechanism, can be adjusted. Further, the occurrence of a resonance in the exhaust pipe 12 is confirmed by an evaluation test or computer simulation performed in advance, and the internal resistance value $\eta$ that fulfills the relationship represented by Eq. (1) above is calculated using a value ($\omega 1/k$) obtained by dividing the resonance frequency $\omega 1$, which is the frequency of this resonance, by the elastic constant k of the exhaust pipe 12. The value of the viscosity of fluid inside the resonance suppression mechanism is then adjusted such that the resonance suppression mechanism has the calculated internal resistance value $\eta$. With such an embodiment, the effects same as those that can be obtained with the above-described first embodiment can be demonstrated.

In the first embodiment and second embodiment, a support member having another resonance suppression mechanism that attenuates the vibrations by using friction may be used instead of the buffer member 23 or the buffer member 43. For example, a support member having a brake mechanism provided with a pair of opposing members and a friction member fixed to the opposing members, as in a vehicle brake, may be used. In such a brake mechanism, the exhaust pipe 12 is supported by sandwiching a protruding portion that protrudes from the exhaust pipe 12 between the pair of opposing members. Where a configuration is used in which a bolt is inserted into the pair of opposing members and a nut is screwed on the bolt, a gap between the opposing members can be adjusted by adjusting the tightening degree of the nut. Thus, the level of friction generated between the friction member of the brake mechanism and the exhaust pipe 12 can be adjusted. With the support member having such a brake mechanism, the vibrations inputted to the brake mechanism are prevented from being reflected by adjusting the degree of friction generated between the support member and the exhaust pipe 12, that is, the internal resistance value $\eta$, such as to fulfill the relationship represented by Eq. (1) above. Therefore, with such an embodiment, the effects same as those that can be obtained with the above-described first embodiment or second embodiment can be demonstrated.

The configurations of the first embodiment, second embodiment, and variation examples each have a resonance suppression mechanism with an adjustable internal resistance as a support member that supports the mostdownstream position in the exhaust pipe 12, but a configuration having a resonance suppression mechanism in which the internal resistance cannot be adjusted can be also used. In such a modification, a plurality of support members that differ in the value of internal resistance of the resonance suppression mechanism are prepared, a support member that is optimum in terms of the vibration characteristic of the exhaust pipe 12 is selected there among, and the mostdownstream position in the exhaust pipe 12 is supported. With such a configuration, the vibrations acting upon the resonance suppression mechanism are also converted into heat and absorbed by the resonance suppression mechanism. Therefore, the vibrations inputted to the resonance suppression mechanism are unlikely to be reflected. By suppressing the reflection of vibrations in such a manner, it is possible to suppress the occurrence of a resonance caused by superposition of the incidence wave propagating from the internal combustion engine 11 in the exhaust pipe 12 toward the downstream side thereof and the reflection wave reflected by the resonance suppression mechanism, and the resonance of the exhaust pipe 12 can be effectively suppressed.

A mechanism other than that attenuating the vibrations by using viscosity or friction can be also used as the resonance suppression mechanism of the support member. Essentially, where a support member having a resonance suppression mechanism that can suppress the vibrations of the exhaust pipe 12 is used as the support member that supports the mostdownstream position in the exhaust pipe 12, a function of suppressing the wide range resonance of the exhaust pipe 12 can be imparted to the resonance suppression mechanism.

In the configuration described in the second embodiment, the acceleration sensor 44 is provided in the exhaust pipe 12 as a sensor for measuring the characteristic of vibrations generated in the exhaust pipe 12. The configuration in which the sensor is mounted on the exhaust pipe 12 is not limiting, and it is also possible to detect the vibration characteristic of the exhaust pipe 12 on the basis of the detection value of the acceleration sensor measuring the acceleration acting upon the vehicle 10 and adjust the internal resistance of the buffer member 43 on the basis of the detected value. Further, it is also possible to estimate the vibration characteristic of the exhaust pipe 12 on the basis of various detection values relating to the internal combustion engine, such as an intake air amount and engine load, and adjust the internal resistance of the buffer member 43 on the basis of the estimated value. With such a configuration, the vibration characteristic of the exhaust pipe 12 can be determined without providing a separate sensor.

In the second embodiment and the variation examples, the value of the internal resistance of the buffer member 43 may be adjusted in the following manner. That is, it is possible to measure the average propagation speed c of the vibrations acting upon the buffer member 43 and adjust the internal resistance value $\eta$ of the buffer member 43, such that the relationship represented by Eq. (1) above is fulfilled, on the basis of the measured average propagation speed c and the tension F of the entire exhaust pipe 12. Further, it is also possible to measure the average density $\sigma$ of the entire exhaust pipe 12, and adjust the internal resistance value $\eta$ of the buffer member 43, such that the relationship represented by Eq. (1) above is fulfilled, on the basis of the measured average density $\sigma$ and the tension F of the entire exhaust pipe 12.

The number and positions of the ball joint unit 13, exhaust purification catalyst 14, and muffler 15 provided in the exhaust pipe 12 can be freely set. Two or more support members, from among a plurality of support members for supporting the exhaust pipe at the vehicle, may have the resonance suppression mechanism. Essentially, the number of the support members having the resonance suppression mechanism can be freely set, provided that at least the support member, from among the plurality of support members, that supports the mostdownstream position in the exhaust pipe 12 has the resonance suppression mechanism.

What is claimed is:

1. A vehicle equipped with an internal combustion engine, an exhaust pipe of the internal combustion engine being supported on a vehicle body by a plurality of support members, the exhaust pipe including at least one muffler, the vehicle comprising:

a resonance suppression mechanism that is provided at at least the support member positioned on a mostdownstream side of the exhaust pipe that is downstream from the at least one muffler, among the plurality of the support members, and the resonance suppression mechanism suppressing a resonance of the exhaust pipe, wherein the resonance suppression mechanist attenuates vibrations acting upon the resonance suppression mechanism by converting the vibrations into heat using viscosity of a fluid.

2. The vehicle according to claim 1, wherein the resonance suppression mechanism has a value of an internal resistance that can be adjusted.

3. The vehicle according to claim 2, wherein the value of the internal resistance in the resonance suppression mechanism is adjusted on the basis of the frequency of vibrations acting upon the resonance suppression mechanism and a tension of the entire exhaust pipe.

4. The vehicle according to claim 2, wherein the value of the internal resistance in the resonance suppression mechanism is adjusted on the basis of a tension of the entire exhaust pipe and either of an average density of the entire exhaust pipe and an average propagation speed of vibrations acting upon the resonance suppression mechanism.

5. The vehicle according to claim 3, further comprising:

a sensor that measures a characteristic of vibrations generated in the exhaust pipe, wherein the value of the internal resistance is adjusted on the basis of a measured value measured by the sensor during engine operation.

6. The vehicle according to claim 1, wherein the resonance suppression mechanism includes inside thereof an elastic member and a liquid chamber filled with a working oil, the liquid chamber being formed to be comparted into two spaces as a pressure receiving chamber and a balancing chamber, and the pressure receiving chamber and the balancing chamber communicating with each other by a communication passage with an adjustable cross-sectional area.

7. A vehicle equipped with an internal combustion engine, an exhaust pipe of the internal combustion engine being supported on a vehicle body by a plurality of support members, the exhaust pipe including at least one muffler, the vehicle comprising:

a resonance suppression mechanism that is provided at at least the support member positioned on a mostdownstream side of the exhaust pipe that is downstream from the at least one muffler, among the plurality of the support members, and the resonance suppression mechanism suppressing a resonance of the exhaust pipe, wherein the resonance suppression mechanism attenuates vibrations acting upon the resonance suppression mechanism by converting the vibrations into heat using friction.

* * * * *